US008800527B2

(12) United States Patent
McAlister

(10) Patent No.: US 8,800,527 B2
(45) Date of Patent: Aug. 12, 2014

(54) METHOD AND APPARATUS FOR PROVIDING ADAPTIVE SWIRL INJECTION AND IGNITION

(71) Applicant: McAlister Technologies, LLC, Phoenix, AZ (US)

(72) Inventor: Roy Edward McAlister, Phoenix, AZ (US)

(73) Assignee: McAlister Technologies, LLC, Phoenix, AZ (US)

( * ) Notice: Subject to any disclaimer, the term of this patent is extended or adjusted under 35 U.S.C. 154(b) by 0 days.

(21) Appl. No.: 13/797,753

(22) Filed: Mar. 12, 2013

(65) Prior Publication Data

US 2014/0137840 A1 May 22, 2014

Related U.S. Application Data

(60) Provisional application No. 61/728,157, filed on Nov. 19, 2012.

(51) Int. Cl.
*F02M 57/06* (2006.01)
*F02M 57/00* (2006.01)

(52) U.S. Cl.
USPC ..... 123/297; 123/298

(58) Field of Classification Search
USPC ..... 123/297, 298, 151, 152, 169 R, 169 V, 123/143 R, 143 B, 608, 301, 306; 239/585.1–585.5, 102.2, 533.12, 408; 313/120
See application file for complete search history.

(56) References Cited

U.S. PATENT DOCUMENTS

| | | | | |
|---|---|---|---|---|
| 1,307,088 | A | 6/1919 | Drummond | |
| 1,451,384 | A | 4/1923 | Whyte | |
| 1,765,237 | A | 6/1930 | King | |
| 2,255,203 | A | 9/1941 | Wiegand | |
| 2,681,212 | A | 6/1954 | Thomas | |
| 2,744,507 | A * | 5/1956 | Huber | 123/294 |

(Continued)

FOREIGN PATENT DOCUMENTS

| | | | |
|---|---|---|---|
| DE | 3443022 | A1 | 5/1986 |
| EP | 392594 | A2 | 10/1990 |
| GB | 1038490 | A | 8/1966 |
| JP | 61-023862 | A | 2/1986 |

OTHER PUBLICATIONS

U.S. Appl. No. 13/844,240, filed Mar. 15, 2013, McAlister.
U.S. Appl. No. 13/844,488, filed Mar. 15, 2013, McAlister.

(Continued)

*Primary Examiner* — Mahmoud Gimie
(74) *Attorney, Agent, or Firm* — Perkins Coie LLP

(57) ABSTRACT

A fuel injector-igniter incorporating adaptive swirl injection and ignition. The fuel injector-igniter comprises a housing, an actuator, and a valve. The valve includes a valve head operative to open and close against a valve seat in response to activation of the actuator. The valve seat includes an electrode portion extending beyond the valve head and within the housing to form at least one gap, such as an annular gap. A current discharge between the housing and electrode portion establishes a plasma and electromagnetic forces driving the plasma from the gap. The injector-igniter may further comprise a power supply connected to the housing and valve seat that is operative to provide the current discharge. The electrode portion includes a plurality of flow shaping features, such as a plurality of twisted fins disposed around the electrode portion and thereby operative to impart a rotation to the plasma.

16 Claims, 11 Drawing Sheets

(56) References Cited

U.S. PATENT DOCUMENTS 2,864,974 A 12/1958 Beye
3,058,453 A 10/1962 May
3,060,912 A 10/1962 May
3,081,758 A 3/1963 May
3,243,335 A 3/1966 Faile
3,373,724 A 3/1968 Papst
3,520,961 A 7/1970 Suda et al.
3,551,738 A 12/1970 Young
3,594,877 A 7/1971 Suda et al.
3,608,050 A 9/1971 Carman et al.
3,689,293 A 9/1972 Beall
3,866,074 A * 2/1975 Smith ..... 313/118
3,926,169 A 12/1975 Leshner et al.
3,931,438 A 1/1976 Beall et al.
3,960,995 A 6/1976 Kourkene
3,976,039 A 8/1976 Henault
3,997,352 A 12/1976 Beall
4,066,046 A 1/1978 McAlister
4,087,719 A * 5/1978 Pratt, Jr. ..... 315/45
4,095,580 A 6/1978 Murray et al.
4,122,816 A 10/1978 Fitzgerald et al.
4,135,481 A 1/1979 Resler, Jr.
RE29,978 E * 5/1979 Leshner et al. ..... 123/297
4,203,393 A 5/1980 Giardini
4,330,732 A 5/1982 Lowther
4,332,223 A 6/1982 Dalton
4,364,342 A 12/1982 Asik
4,377,455 A 3/1983 Kadija et al.
4,381,740 A 5/1983 Crocker
4,382,189 A 5/1983 Wilson
4,448,160 A 5/1984 Vosper
4,469,160 A 9/1984 Giamei
4,483,485 A 11/1984 Kamiya et al.
4,511,612 A 4/1985 Huther et al.
4,528,270 A 7/1985 Matsunaga
4,536,452 A 8/1985 Stempin et al.
4,567,857 A 2/1986 Houseman et al.
4,574,037 A 3/1986 Samejima et al.
4,677,960 A 7/1987 Ward
4,688,538 A 8/1987 Ward et al.
4,733,646 A 3/1988 Iwasaki
4,736,718 A 4/1988 Linder
4,742,265 A 5/1988 Giachino et al.
4,760,818 A 8/1988 Brooks et al.
4,760,820 A 8/1988 Tozzi
4,774,914 A 10/1988 Ward
4,774,919 A 10/1988 Matsuo et al.
4,834,033 A 5/1989 Larsen
4,841,925 A * 6/1989 Ward ..... 123/143 B
4,922,883 A 5/1990 Iwasaki
4,932,263 A 6/1990 Wlodarczyk
4,967,708 A 11/1990 Linder et al.
4,977,873 A 12/1990 Cherry et al.
4,982,708 A 1/1991 Stutzenberger
5,034,852 A 7/1991 Rosenberg
5,055,435 A 10/1991 Hamanaka et al.
5,056,496 A 10/1991 Morino et al.
5,072,617 A 12/1991 Weiss
5,076,223 A 12/1991 Harden et al.
5,095,742 A 3/1992 James et al.
5,109,817 A 5/1992 Cherry
5,131,376 A 7/1992 Ward et al.
5,193,515 A 3/1993 Oota et al.
5,207,208 A 5/1993 Ward
5,211,142 A 5/1993 Matthews et al.
5,220,901 A 6/1993 Morita et al.
5,267,601 A 12/1993 Dwivedi
5,297,518 A 3/1994 Cherry
5,305,360 A 4/1994 Remark et al.
5,328,094 A 7/1994 Goetzke et al.
5,377,633 A 1/1995 Wakeman
5,390,546 A 2/1995 Wlodarczyk
5,392,745 A 2/1995 Beck
5,394,838 A 3/1995 Chandler
5,421,195 A 6/1995 Wlodarczyk
5,421,299 A 6/1995 Cherry
5,435,286 A 7/1995 Carroll, III et al.
5,439,532 A 8/1995 Fraas
5,456,241 A 10/1995 Ward
5,475,772 A 12/1995 Hung et al.
5,497,744 A * 3/1996 Nagaosa et al. ..... 123/297
5,517,961 A 5/1996 Ward
5,531,199 A 7/1996 Bryant et al.
5,549,746 A 8/1996 Scott et al.
5,584,490 A 12/1996 Inoue et al.
5,588,299 A 12/1996 DeFreitas
5,605,125 A 2/1997 Yaoita
5,607,106 A 3/1997 Bentz et al.
5,662,389 A 9/1997 Truglio et al.
5,676,026 A 10/1997 Tsuboi et al.
5,694,761 A 12/1997 Griffin, Jr.
5,699,253 A 12/1997 Puskorius et al.
5,702,761 A 12/1997 DiChiara, Jr. et al.
5,704,321 A 1/1998 Suckewer et al.
5,715,788 A 2/1998 Tarr et al.
5,738,818 A 4/1998 Atmur et al.
5,746,171 A 5/1998 Yaoita
5,767,026 A 6/1998 Kondoh et al.
5,797,427 A 8/1998 Buescher
5,806,581 A 9/1998 Haasch et al.
5,853,175 A 12/1998 Udagawa
5,863,326 A 1/1999 Nause et al.
5,876,659 A 3/1999 Yasutomi et al.
5,915,272 A 6/1999 Foley et al.
5,941,207 A 8/1999 Anderson et al.
5,975,032 A 11/1999 Iwata
5,975,433 A * 11/1999 Hasegawa et al. ..... 239/533.12
5,983,855 A * 11/1999 Benedikt et al. ..... 123/297
6,017,390 A 1/2000 Charych et al.
6,026,568 A 2/2000 Atmur et al.
6,062,498 A 5/2000 Klopfer
6,065,692 A * 5/2000 Brinn, Jr. ..... 239/533.12
6,081,183 A 6/2000 Mading et al.
6,085,990 A 7/2000 Augustin
6,092,501 A 7/2000 Matayoshi et al.
6,092,507 A 7/2000 Bauer et al.
6,093,338 A 7/2000 Tani et al.
6,102,303 A 8/2000 Bright et al.
6,131,607 A 10/2000 Cooke
6,138,639 A 10/2000 Hiraya et al.
6,173,913 B1 1/2001 Shafer et al.
6,185,355 B1 2/2001 Hung
6,186,419 B1 * 2/2001 Kampmann et al. ..... 239/533.3
6,189,522 B1 2/2001 Moriya
6,253,728 B1 7/2001 Matayoshi et al.
6,267,307 B1 7/2001 Pontoppidan
6,335,065 B1 1/2002 Steinlage et al.
6,338,445 B1 1/2002 Lambert et al.
6,360,721 B1 3/2002 Schuricht et al.
6,378,485 B2 4/2002 Elliott
6,386,178 B1 5/2002 Rauch
6,453,660 B1 9/2002 Johnson et al.
6,455,173 B1 9/2002 Marijnissen et al.
6,478,007 B2 11/2002 Miyashita et al.
6,506,336 B1 1/2003 Beall et al.
6,517,011 B1 2/2003 Ayanji et al.
6,532,315 B1 3/2003 Hung et al.
6,536,405 B1 3/2003 Rieger et al.
6,567,599 B2 5/2003 Hung
6,568,362 B2 * 5/2003 Whealton et al. ..... 123/143 B
6,578,775 B2 6/2003 Hokao
6,583,901 B1 6/2003 Hung
6,584,244 B2 6/2003 Hung
6,587,239 B1 7/2003 Hung
6,615,899 B1 9/2003 Woodward et al.
6,647,948 B2 11/2003 Kyuuma et al.
6,663,027 B2 12/2003 Jameson et al.
6,672,277 B2 1/2004 Yasuoka et al.
6,687,597 B2 2/2004 Sulatisky et al.
6,700,306 B2 3/2004 Nakamura et al.
6,705,274 B2 3/2004 Kubo
6,712,035 B2 3/2004 Gottemoller et al.
6,722,340 B1 4/2004 Sukegawa et al.
6,725,826 B2 4/2004 Esteghlal

(56) References Cited

U.S. PATENT DOCUMENTS

| | | | | |
|---|---|---|---|---|
| 6,745,744 | B2 | 6/2004 | Suckewer et al. | |
| 6,748,918 | B2 | 6/2004 | Rieger et al. | |
| 6,749,043 | B2 | 6/2004 | Brown et al. | |
| 6,763,811 | B1 | 7/2004 | Tamol, Sr. | |
| 6,776,358 | B2 * | 8/2004 | Arimoto | 239/533.3 |
| 6,796,516 | B2 | 9/2004 | Maier et al. | |
| 6,832,588 | B2 | 12/2004 | Herden et al. | |
| 6,845,608 | B2 | 1/2005 | Klenk et al. | |
| 6,845,920 | B2 | 1/2005 | Sato et al. | |
| 6,850,069 | B2 | 2/2005 | McQueeney et al. | |
| 6,851,413 | B1 | 2/2005 | Tamol, Sr. | |
| 6,871,630 | B2 | 3/2005 | Herden et al. | |
| 6,883,490 | B2 | 4/2005 | Jayne | |
| 6,899,076 | B2 | 5/2005 | Funaki et al. | |
| 6,904,893 | B2 | 6/2005 | Hotta et al. | |
| 6,912,998 | B1 | 7/2005 | Rauznitz et al. | |
| 6,925,983 | B2 | 8/2005 | Herden et al. | |
| 6,940,213 | B1 | 9/2005 | Heinz et al. | |
| 6,959,693 | B2 | 11/2005 | Oda | |
| 6,976,683 | B2 | 12/2005 | Eckert et al. | |
| 6,994,073 | B2 | 2/2006 | Tozzi et al. | |
| 7,007,658 | B1 | 3/2006 | Cherry et al. | |
| 7,013,863 | B2 | 3/2006 | Shiraishi et al. | |
| 7,025,358 | B2 | 4/2006 | Ueta et al. | |
| 7,032,845 | B2 | 4/2006 | Dantes et al. | |
| 7,070,126 | B2 | 7/2006 | Shinogle | |
| 7,073,480 | B2 | 7/2006 | Shiraishi et al. | |
| 7,086,376 | B2 | 8/2006 | McKay | |
| 7,104,246 | B1 | 9/2006 | Gagliano et al. | |
| 7,104,250 | B1 | 9/2006 | Yi et al. | |
| 7,121,253 | B2 | 10/2006 | Shiraishi et al. | |
| 7,131,426 | B2 | 11/2006 | Ichinose et al. | |
| 7,140,347 | B2 | 11/2006 | Suzuki et al. | |
| 7,249,578 | B2 | 7/2007 | Fricke et al. | |
| 7,255,290 | B2 | 8/2007 | Bright et al. | |
| 7,275,374 | B2 | 10/2007 | Stewart et al. | |
| 7,278,392 | B2 | 10/2007 | Zillmer et al. | |
| 7,278,396 | B2 | 10/2007 | Leone et al. | |
| 7,287,492 | B2 | 10/2007 | Leone et al. | |
| 7,293,552 | B2 | 11/2007 | Leone et al. | |
| 7,302,933 | B2 | 12/2007 | Kerns | |
| 7,309,029 | B2 | 12/2007 | Boecking | |
| 7,357,101 | B2 | 4/2008 | Boyarski | |
| 7,406,947 | B2 | 8/2008 | Lewis et al. | |
| 7,409,929 | B2 | 8/2008 | Miyahara et al. | |
| 7,412,966 | B2 | 8/2008 | Lewis et al. | |
| 7,418,940 | B1 | 9/2008 | Yi et al. | |
| 7,481,043 | B2 | 1/2009 | Hirata et al. | |
| 7,513,222 | B2 | 4/2009 | Orlosky | |
| 7,554,250 | B2 | 6/2009 | Kadotani et al. | |
| 7,625,531 | B1 | 12/2009 | Coates et al. | |
| 7,626,315 | B2 | 12/2009 | Nagase | |
| 7,650,873 | B2 | 1/2010 | Hofbauer et al. | |
| 7,703,435 | B2 | 4/2010 | Surnilla et al. | |
| 7,703,775 | B2 | 4/2010 | Matsushita et al. | |
| 7,707,832 | B2 | 5/2010 | Commaret et al. | |
| 7,714,483 | B2 | 5/2010 | Hess et al. | |
| 7,728,489 | B2 | 6/2010 | Heinz et al. | |
| 7,849,833 | B2 | 12/2010 | Toyoda | |
| 7,861,696 | B2 | 1/2011 | Lund | |
| 7,918,212 | B2 | 4/2011 | Verdejo et al. | |
| 8,069,836 | B2 | 12/2011 | Ehresman | |
| 8,147,599 | B2 | 4/2012 | McAlister | |
| 8,312,759 | B2 | 11/2012 | McAlister | |
| 8,322,325 | B2 | 12/2012 | Rogak et al. | |
| 8,441,361 | B2 | 5/2013 | McAlister | |
| 2002/0017573 | A1 | 2/2002 | Sturman | |
| 2002/0084793 | A1 | 7/2002 | Hung et al. | |
| 2002/0131171 | A1 | 9/2002 | Hung | |
| 2002/0131666 | A1 | 9/2002 | Hung et al. | |
| 2002/0131673 | A1 | 9/2002 | Hung | |
| 2002/0131674 | A1 | 9/2002 | Hung | |
| 2002/0131706 | A1 | 9/2002 | Hung | |
| 2002/0131756 | A1 | 9/2002 | Hung | |
| 2002/0141692 | A1 | 10/2002 | Hung | |
| 2002/0150375 | A1 | 10/2002 | Hung et al. | |
| 2002/0151113 | A1 | 10/2002 | Hung et al. | |
| 2004/0008989 | A1 | 1/2004 | Hung | |
| 2005/0255011 | A1 | 11/2005 | Greathouse et al. | |
| 2006/0005738 | A1 | 1/2006 | Kumar | |
| 2006/0005739 | A1 | 1/2006 | Kumar | |
| 2006/0037563 | A1 | 2/2006 | Raab et al. | |
| 2007/0189114 | A1 | 8/2007 | Reiner et al. | |
| 2009/0093951 | A1 | 4/2009 | McKay et al. | |
| 2009/0223474 | A1 * | 9/2009 | Ehrlich | 123/143 B |
| 2010/0077986 | A1 | 4/2010 | Chen | |
| 2013/0149621 | A1 | 6/2013 | McAlister | |

OTHER PUBLICATIONS

International Search Report and Written Opinion for Application No. PCT/US2010/002076; Applicant: McAlister Technologies, LLC.; Date of Mailing: Apr. 29, 2011 (8 pages).

International Search Report and Written Opinion for Application No. PCT/US2010/059147; Applicant: McAlister Technologies, LLC.; Date of Mailing: Aug. 31, 2011, 11 pages.

"Ford DIS/EDIS "Waste Spark" Ignition System." Accessed: Jul. 15, 2010. Printed: Jun. 8, 2011. <http://rockledge.home.comcast.net/~rockledge/RangerPictureGallery/DIS_EDIS.htm>. pp. 1-6.

"P dV's Custom Data Acquisition Systems Capabilities." PdV Consulting. Accessed: Jun. 28, 2010. Printed: May 16, 2011. <http://www.pdvconsult.com/capabilities%20-%20daqsys.html>. pp. 1-10.

"Piston motion equations." Wikipedia, the Free Encyclopedia. Published: Jul. 4, 2010. Accessed: Aug. 7, 2010. Printed: Aug. 7, 2010. <http://en.wikipedia.org/wiki/Dopant>. pp. 1-9.

"Piston Velocity and Acceleration." EPI, Inc. Accessed: Jun. 28, 2010. Printed: May 16, 2011. <http://www.epi-eng.com/piston_engine_technology/piston_velocity_and_acceleration.htm>. pp. 1-3.

"SmartPlugs—Aviation." SmartPlugs.com. Published: Sep. 2000. Accessed: May 31, 2011. <http://www.smartplugs.com/news/aeronews0900.htm>. pp. 1-3.

Birchenough, Arthur G. "A Sustained-arc Ignition System for Internal Combustion Engines." NASA Technical Memorandum (NASA TM-73833). Lewis Research Center. Nov. 1977. pp. 1-15.

Doggett, William. "Measuring Internal Combustion Engine In-Cylinder Pressure with LabVIEW." National Instruments. Accessed: Jun. 28, 2010. Printed: May 16, 2011. <http://sine.ni.com/cs/app/doc/p/id/cs-217>. pp. 1-2.

Erjavec, Jack. "Automotive Technology: a Systems Approach, vol. 2." Thomson Delmar Learning. Clifton Park, NY. 2005. p. 845.

Hollembeak, Barry. "Automotive Fuels & Emissions." Thomson Delmar Learning. Clifton Park, NY. 2005. p. 298.

InfraTec GmbH. "Evaluation Kit for FPI Detectors | Datasheet—Detector Accessory." 2009. pp. 1-2.

Lewis Research Center. "Fabry-Perot Fiber-Optic Temperature Sensor." NASA Tech Briefs. Published: Jan. 1, 2009. Accessed: May 16, 2011. <http://www.techbriefs.com/content/view/2114/32/>.

Riza et al. "All-Silicon Carbide Hybrid Wireless-Wired Optics Temperature Sensor Network Basic Design Engineering for Power Plant Gas Turbines." International Journal of Optomechatronics, vol. 4, Issue 1. Jan. 2010. pp. 1-9.

Riza et al. "Hybrid Wireless-Wired Optical Sensor for Extreme Temperature Measurement in Next Generation Energy Efficient Gas Turbines." Journal of Engineering for Gas Turbines and Power, vol. 132, Issue 5. May 2010. pp. 051601-1-51601-11.

* cited by examiner

METHOD AND APPARATUS FOR PROVIDING ADAPTIVE SWIRL INJECTION AND IGNITION

CROSS-REFERENCE TO RELATED APPLICATION

The present application claims the benefit of U.S. Provisional Patent Application No. 61/728,157, filed Nov. 19, 2012, the disclosure of which is hereby incorporated by reference in its entirety.

BACKGROUND

In instances in which alternative fuels with low cetane ratings, such as hydrogen, methane, producer gas, and fuel alcohols, are substituted for diesel fuel in engines designed for compression ignition, it is necessary to provide positive ignition to enable suitable combustion and application of such alternative fuels. Optimized application of each alternative fuel selection requires adjustment of variables such as the timing of fuel injection and ignition events along with the amount of energy that is applied to pressurize and ignite the delivered fuel. Accordingly, there is a need for fuel system hardware and methods to facilitate the optimization of variables associated with injection and ignition of various alternative fuels.

BRIEF DESCRIPTION OF THE DRAWINGS

Representative embodiments of the devices, systems, and methods, are described with reference to the following figures, wherein like reference numerals refer to like parts throughout the various view unless otherwise specified.

DETAILED DESCRIPTION

Figure 1:
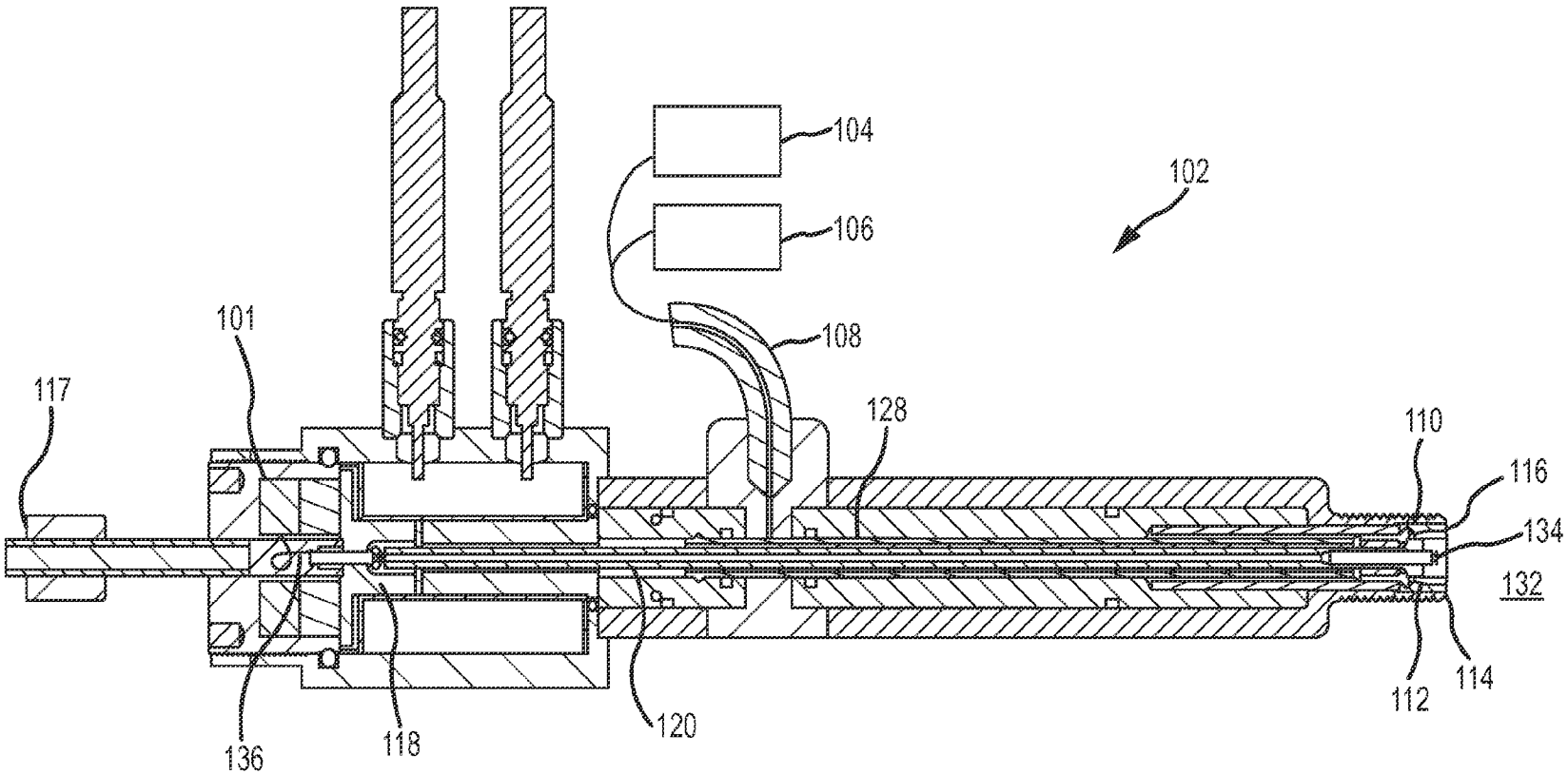
FIG. 1 is a cross-sectional side view in elevation of an injector-igniter according to a first representative embodiment.

Disclosed herein are injector-igniters according to several representative embodiments that provide adaptive swirl injection and ignition. Adaptive swirl injection and ignition enables utilization of less expensive fuels, such as hydrogen, methane, various alcohols, and other alternative fuels. Adaptive swirl injection and ignition enables optimization of combustion and stratified heat generation to achieve greater air utilization efficiency than is typical in compression-ignition engines using diesel fuel. Accordingly, objectionable emissions may be greatly reduced or eliminated.

Disclosed herein are injector-igniters according to several representative embodiments that provide adaptive swirl injection and ignition. Adaptive swirl injection and ignition can enable optimization of combustion and stratified heat generation to achieve improved air utilization efficiency thereby reducing objectionable emissions, improving fuel economy, and increasing engine performance. In a representative embodiment, a fuel injector-igniter comprises a housing, an actuator, and a valve. The valve includes a valve head operative to open and close against a valve seat in response to activation of the actuator. The valve seat includes an electrode portion extending beyond the valve head and within the housing to form at least one gap, such as an annular gap. A current discharge between the housing and electrode portion establishes plasma and electro-magnetic forces that drive the plasma from the gap. The injector-igniter may further comprise one or more power supplies connected to the housing and valve seat that is operative to provide fuel valve operation and/or the current discharge.

In one aspect of the present technology disclosed herein, the electrode portion includes a plurality of flow shaping features, such as a plurality of fins disposed around the electrode portion. In some embodiments the fins are twisted, and thereby operative to impart a rotation or swirl to the plasma. In other aspects of the technology, the electrode portion includes a plurality of ports in fluid communication with the annular gap. In still other aspects of the present technology, the electrode portion comprises a magnetic material.

In another embodiment, a fuel injector-igniter comprises a housing, a power supply, an actuator, a valve, and a valve seat electrode. The valve seat electrode includes a valve seat and an electrode portion extending beyond the valve seat within the housing to form an annular gap. The valve includes a valve head operative to open and close against the valve seat in response to activation of the actuator. The power supply is operative to produce a current discharge between the housing and electrode portion establishing plasma and electro-magnetic forces that drive the plasma from the annular gap.

Also disclosed herein are methods of injecting and igniting fuel in a combustion chamber. In a representative embodiment, the method comprises introducing the fuel into an annular region between two electrodes; providing a current across the two electrodes and through the fuel to establish a plasma; maintaining the current across the two electrodes to establish Lorentz forces driving the plasma from the annular region and into the combustion chamber; and imparting rotation on the fuel and plasma as it is driven from the annular region. In an embodiment, the method further comprises applying a rapid application of voltage to the two electrodes whereby ionization between the two electrodes is avoided, thereby causing a corona discharge to extend into the combustion chamber.

In other embodiments, the combustion chamber contains a rotating oxidant and the rotation of the fuel and plasma is counter to the rotating oxidant. In still other embodiments, the rotation of the fuel and plasma is the same direction as the rotating oxidant. In some embodiments, the rotation of the fuel and plasma is imparted via a plurality of flow shaping features disposed on at least one of the two electrodes. In other embodiments the rotation is induced by a magnetic field.

Specific details of several embodiments of the technology are described below with reference to FIGS. 1-14. Other details describing well-known fuel system components, such as fuel pumps, regulators, and the like, have not been set forth in the following disclosure to avoid unnecessarily obscuring the description of the various embodiments of the technology. Many of the details, dimensions, angles, and other features shown in the figures are merely illustrative of particular embodiments of the technology. Accordingly, other embodiments can have other details, dimensions, angles, and features without departing from the spirit or scope of the present technology. A person of ordinary skill in the art, therefore, will accordingly understand that the technology may have other embodiments with additional elements, or the technology may have other embodiments without several of the features shown and described below with reference to FIGS. 1-14.

Some aspects of the technology described below may take the form of computer-executable instructions, including routines executed by a programmable computer. Those skilled in the relevant art will appreciate that the technology can be practiced on computer systems other than those shown and described below. The technology can be embodied in a special-purpose computer or data processor, such as an engine control unit (ECU), engine control module (ECM), fuel system controller, or the like, that is specifically programmed, configured or constructed to perform one or more of the computer-executable instructions described below. Accordingly, the term "computer," "processor," or "controller" as generally used herein refers to any data processor and can include ECUs, ECMs, and modules, as well as Internet appliances and hand-held devices (including palm-top computers, wearable computers, cellular or mobile phones, multi-processor systems, processor-based or programmable consumer electronics, network computers, mini computers and the like). Information handled by these computers can be presented at any suitable display medium, including a CRT display, LCD, or dedicated display device or mechanism (e.g., gauge).

The technology can also be practiced in distributed environments, where tasks or modules are performed by remote processing devices that are linked through a communications network. In a distributed computing environment, program modules or subroutines may be located in local and remote memory storage devices. Aspects of the technology described below may be stored or distributed on computer-readable media, including magnetic or optically readable or removable computer disks, as well as distributed electronically over networks. Such networks may include, for example and without limitation, Controller Area Networks (CAN), Local Interconnect Networks (LIN), and the like. In particular embodiments, data structures and transmissions of data particular to aspects of the technology are also encompassed within the scope of the technology.

Figure 2:
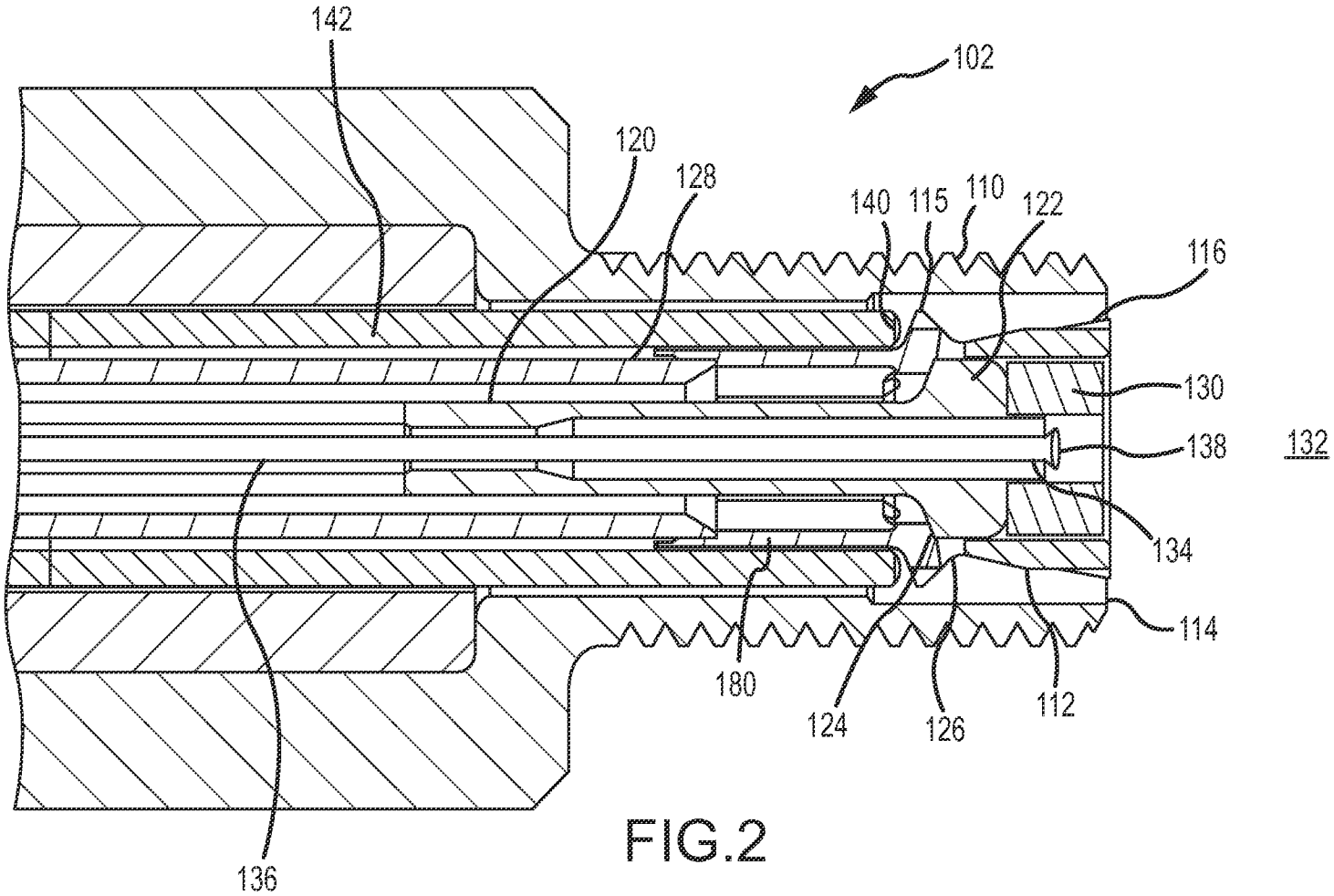
FIG. 2 is a partial cross-sectional side view of the injector-igniter shown in FIG. 1.

FIGS. 1 and 2 show an injector-igniter 102 incorporating adaptive swirl injection and ignition technology according to a first representative embodiment. Injector-igniter 102 is provided with a microprocessor or computer 101 to control injection of fuel supplied through a valve seat electrode 112. Although the controller 101 and igniter circuits 104, 106 are shown as separate components or assemblies, in other embodiments the functions of the controller 101 and circuits 104, 106 may be integrated into a compact control unit.

Injector-igniter 102 receives fuel from a suitable supply such as a pipeline or vehicle fuel system (not shown) providing fuel to the injector-igniter at variable pressure through pressure regulator 117. Fuel flows through and/or around armature 118, along annular passageway 120 and the stem connecting armature 118 to valve head 122 to a valve seat electrode 112 as shown in FIG. 2. Valve seat electrode 112 includes a valve seat 124, an electrode portion 116, and a ferrule 180 for attachment to conductor tube 128. When actuated, valve actuator 118 opens the fuel metering valve by lifting valve head 122 off of valve seat 124 (see FIG. 2) to allow fuel to flow past valve head 122 and through radial ports 126. Radial ports 126 are formed through the electrode portion 116 adjacent the seat 124. Fuel flows through radial ports 126 and into the annular passageway between the electrode portion 114 of the housing 110 and electrode portion 116 of the valve seat electrode 112 as shown.

Once fuel flows into the annular passageway between the electrodes 114, 116, the fuel is accelerated into combustion chamber 132 and ignited by Lorentz thrusting. To initiate Lorentz thrusting, power supply 104 provides a relatively long duration electric field through cable 108 to conductive tube 128 and through electrode valve seat 112 (including electrode portion 116) to produce sufficient field strength for initial ionization of the fuel and/or air that is between electrodes 114 and edge or tips 115 of electrode 112-116. Upon establishment of an ionized particle path, the electrical resistance drops and the current rapidly builds between electrodes 114 and 116 which causes Lorentz thrust towards the combustion chamber 132. Ignition through Lorentz thrusting is known to those of skill in the art, and is described in more detail in U.S. Pat. No. 4,122,816, which is incorporated herein by reference in its entirety. To the extent the foregoing patent and/or any other materials incorporated herein by reference conflict with the present disclosure, the present disclosure controls.

Adaptive control of the launch velocity into combustion chamber 132 of the population of ions that form the current, along with other particles that are swept along, is established by the current as provided by circuit 104, which is adjustable from sub-sonic to super-sonic speeds. Such Lorentz launches of ionized particles may be repeated at an adaptively controlled frequency to produce waves of ionized bursts into the combustion chamber. Ignition events triggered by adaptively adjusted Lorentz thrusting of ion current through the oxidant and/or fuel produces the desired penetration and combustion pattern. Instrumentation such as fiber optic linked sensors 134 provide feedback information to computer 101 about the penetration extend and pattern for purposes of such adaptive adjustment for optimization of achievements such as stratified heat release, engine performance, fuel economy and emissions reductions or elimination.

After a suitable ion current population is accelerated by Lorentz thrusting conversion of electrical energy from operation of circuit 104 and launched into the oxidant in combustion chamber 132, controller 101 may further provide another type of combustion initiation and/or acceleration, such as corona discharge, by operation of circuit 106. Circuit 106 is operative to provide one or more sufficiently rapid applications of voltage to avoid ionization between electrodes 114 and 116 thereby causing a corona discharge to extend into or occur near or within the stratified distribution of particles previously launched by a Lorentz thrusting event as described above. Such adaptive control of various parameters and combinations including fuel pressure, fuel flow periods, ionized particle Lorentz thrust accelerations, and corona ignition provides the ability to interchangeably optimize applications of a wide range of alternative fuels such as hydrogen, producer gas, landfill gas, methane, natural gas, ethane, propane, butane, fuel alcohols, and ammonia along with gasoline, jet, and diesel fuels including preheated fuels.

Figure 3A:
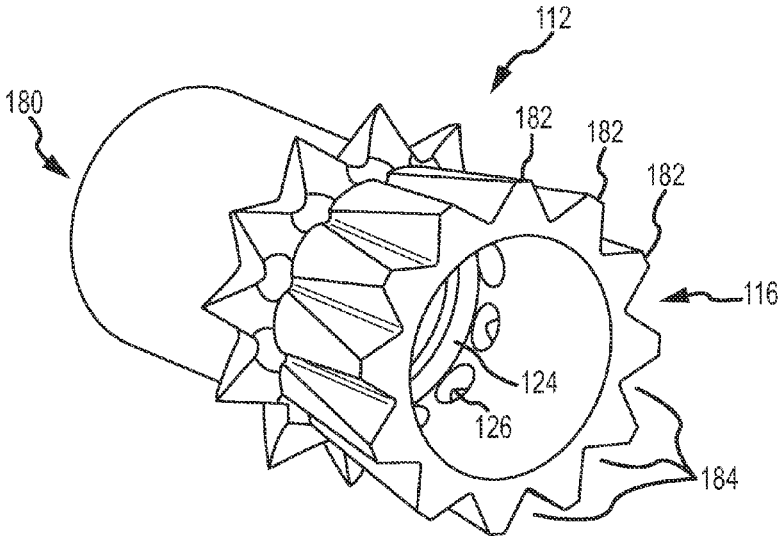
FIG. 3A is a perspective view of the valve seat electrode shown in FIGS. 1 and 2.
Figure 3B:
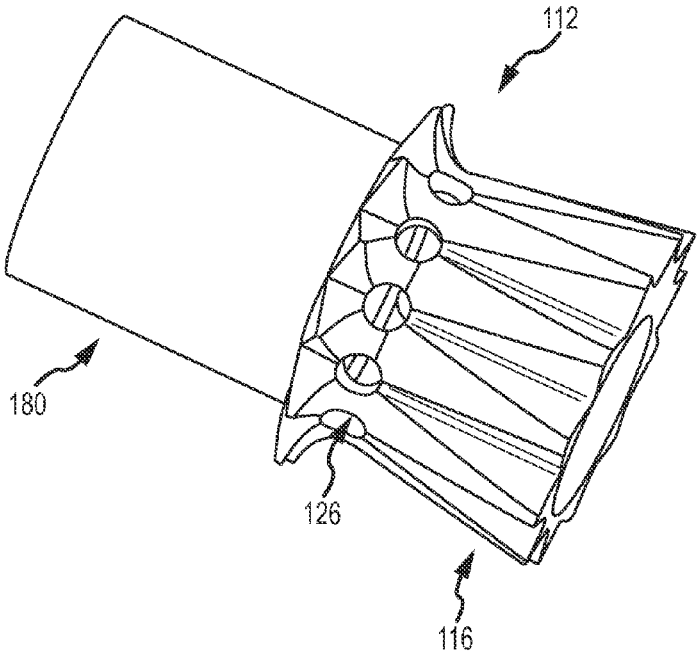
FIG. 3B is a perspective view of the valve seat electrode shown in FIGS. 1-3A.

With reference to FIGS. 3A and 3B, electrode portion 116 may include flow shaping channels 184 located between fins 182. In addition to including flow shaping features, such as fins 182, the valve seat electrode 112 may be made of permanent magnet materials or include electromagnets to provide magnetic focusing and/or radial acceleration of ions that are thrust into the combustion chamber. Shaping fins 182 and/or channels 184 launch ions and/or other swept particles that traverse pre-existing oxidant swirl in the combustion chamber 132. In this embodiment the electrode portion 116 launches the ions straight (e.g., radially) into the combustion chamber. The valve seat electrode 112 may be made from a sintered, powdered magnetic material, for example. In other embodiments, the valve seat electrode 112 may be made from a suitable steel, cobalt or nickel alloy for use as an electromagnet.

Figure 4A:
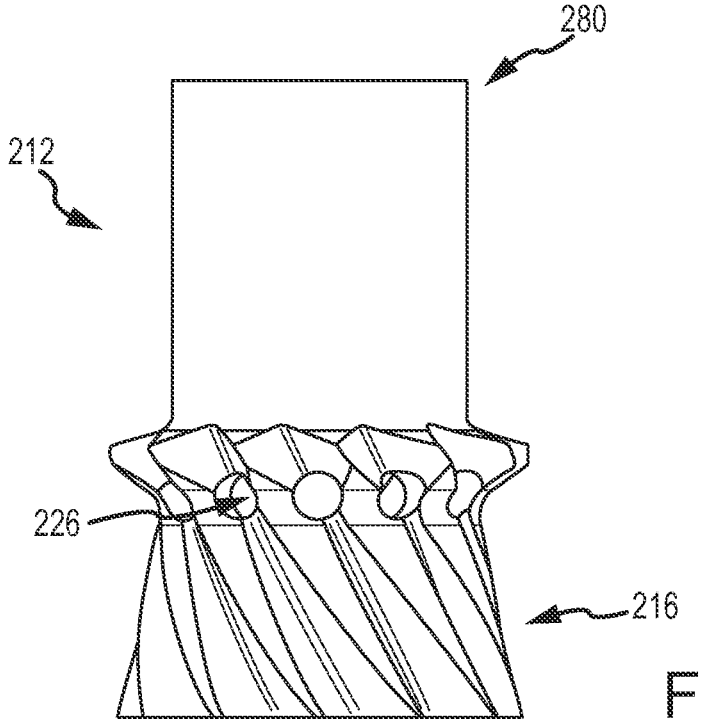
FIG. 4A is a side view in elevation of a valve seat electrode according to another representative embodiment.
Figure 4B:
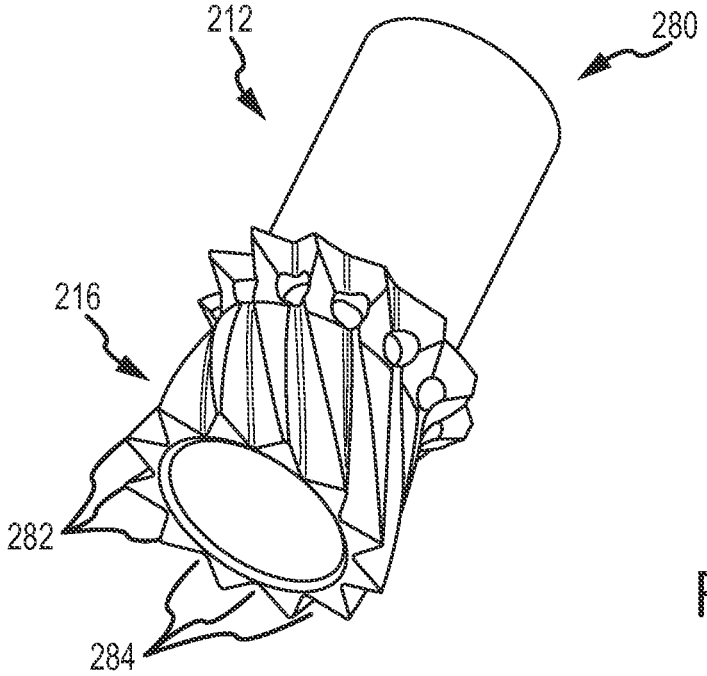
FIG. 4B is a perspective view of the valve seat electrode shown in FIG. 4A.

In other embodiments, the fins can be angled or twisted in a helical pattern, for example, which launch the ions in a swirled or vortex pattern. FIGS. 4A and 4B illustrate a valve seat electrode 212 according to another representative embodiment. Valve seat electrode 212 includes an interior valve seat, an electrode portion 216, fuel ports 226, and a ferrule 280, all similar to valve seat electrode 112 described above. Except, in this case, the fins 282 may in selected regions and extents be volutes or otherwise twisted clockwise or counterclockwise depending upon whether it is desired to complement pre-existing swirl of oxidant in the combustion chamber or to oppose it. The angles of the fins and integrated patterns of oxidant and/or fuel particles and/or ion projections into the combustion chamber are thus adjustable according to fuel supply pressure, magnetic influences, and current developed across the electrodes. Electrode current controls can be varied as the current is thrust to adjust the included angle and penetration distance of any number of patterns that are thrust at variable intervals into the oxidant in combustion chamber 132 for purposes of maximizing oxidant-utilization efficiency and engine performance. The helical electrode features 282 and corresponding channels 284 produce or enhance the angular velocity of ion currents that are accelerated by the Lorentz thrust.

In addition to helical fins, the injection pattern may be influenced or controlled by magnetic forces exerted by one or more magnets (e.g., permanent or electro). Referring again to FIG. 2, ring magnet 130 with selected north and south pole positions or patterns is disposed on valve head 122, which positions ring magnet 130 near the annular region between electrodes 114 and 116. Accordingly, ring magnet 130 is operative to influence the current that is accelerated from the annular region. Ring magnet 130 may be a permanent magnet or an electromagnet. Embodiments using an electromagnet provide for adaptive adjustment of the included angle for activated oxidant ion or fuel injection as a function of the variable fuel pressure supplied to the injector and Lorentz thrust velocity. Helical electrode features and pathways may be mild or highly exaggerated to interact with or enhance such adaptive adjustments and/or to increase the heat transfers for thermal activation purposes.

Swirl induced stratified pattern control as provided by the presently disclosed technology can be optimized for each type of combustion chamber and swirl conditions that may be encountered in various engines including two- and four-stroke piston engines. This provides improved air utilization efficiency in which air supplies the oxidant particles required for accelerated completion of combustion along with effective thermal insulation of combustion gases, and expansive work production by such insulating air that receives heat and/or kinetic energy by such operations.

Figure 5:
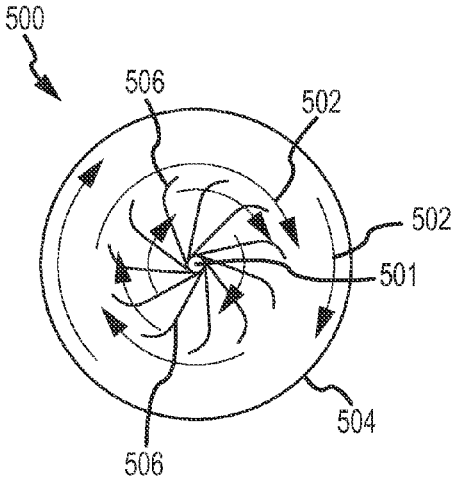
FIG. 5 is a perspective view illustrating a representative swirl pattern according to the present technology.

FIG. 5 illustrates an example of injector swirl that complements the air flow within cylinder 500. In this example there are generally clockwise swirl components of oxidant 502 moving around an axis more or less parallel to the piston motion in a portion of combustion chamber 504. Fuel and/or oxidant fluid ion and/or particle injection vectors 506 extend from a centrally positioned injector 501. Injector 501 is equipped with a valve seat electrode having an electrode portion with a fin configuration similar to that shown in FIGS. 4A and 4B. Except, in this case the fins are twisted the opposite direction to provide swirl that is sympathetic to the oxidant flow in the chamber 504.

Figure 6:
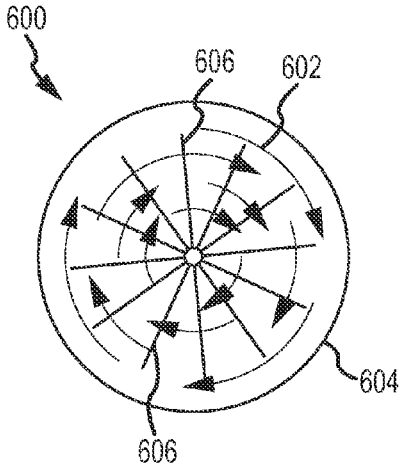
FIG. 6 is a perspective view illustrating another representative swirl pattern according to the present technology.

FIG. 6 illustrates an example without injector swirl, wherein the injection vectors 606 are directed radially into the oxidant air flow 602. In this example there are generally clockwise swirl components of oxidant 602 moving around the cylinder 600 about an axis more or less parallel to the piston motion in a portion of combustion chamber 604. In this case the injector is equipped with a valve seat electrode having an electrode portion with a fin configuration similar to that shown in FIGS. 3A and 3B. In this case the fins extend axially with respect to the injector.

Figure 7:
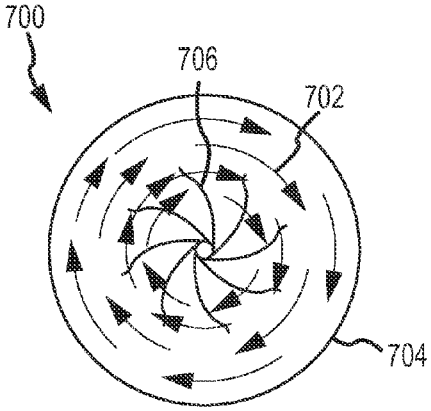
FIG. 7 is a perspective view illustrating an additional representative swirl pattern according to the present technology.

FIG. 7 illustrates an example of injector swirl that is counter to the air flow within cylinder 700. In this example there are generally clockwise air flow components of oxidant 702 moving around an axis parallel to the piston motion in a portion of combustion chamber 704. Fuel and/or oxidant fluid ion and/or particle injection vectors 706 initially are opposed to the oxidant air flow 702 as shown. In this case the injector is equipped with a valve seat electrode having an electrode portion with a fin configuration similar to that shown in FIGS. 4A and 4B. In this case, the fins are twisted to provide swirl that is counter to the oxidant flow in the combustion chamber 704. This configuration is particularly beneficial for operation in relatively high compression ratio engines and/or at higher supercharger boost pressures. Such conditions of operation produce more concentrated availability of oxygen such that combustion can be completed in a smaller volume of oxidant to maximize air utilization efficiency.

Figure 8:
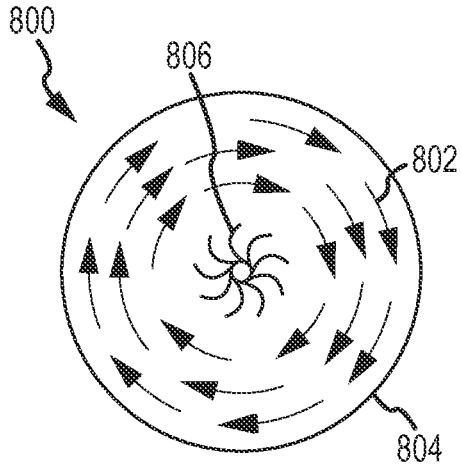
FIG. 8 is a perspective view illustrating yet another representative swirl pattern according to the present technology.

FIG. 8 illustrates another example of injector swirl that is counter to the air flow within cylinder 800. This embodiment optimizes one or more oxidant ionizations and launches such ions in to a stratified oxidant charge that is overtaken by higher velocity launches of fuel ions. In this example there are generally clockwise air flow components of oxidant 802 moving around an axis parallel to the piston motion in a portion of combustion chamber 804. Fuel and/or oxidant fluid ion and/or particle injection vectors 806 initially are opposed to the oxidant air flow 802 as shown. In this case the injector is equipped with a valve seat electrode having an electrode portion with a fin configuration similar to that shown in FIGS. 4A and 4B. In this case, the fins are twisted to provide swirl that is counter to the oxidant flow in the chamber 804. Such operation of oxidant activation which may be accomplished just prior to fuel injection is particularly beneficial for operation in relatively lower compression ratio engines and/or at lower supercharger boost pressures. Accordingly more activated oxidant is available and combustion can be completed in a smaller volume of oxidant to maximize air utilization efficiency.

Figure 9:
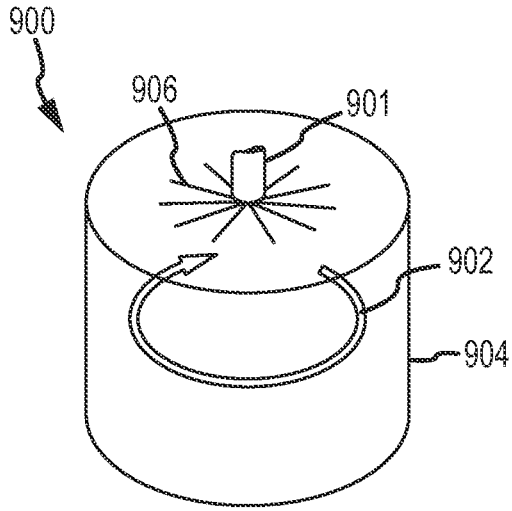
FIG. 9 is a perspective view illustrating a further representative swirl pattern according to the present technology.

FIG. 9 illustrates another example of swirl optimization. In this case the combustion chamber 904 includes an air flow pattern 902 which tumbles within cylinder 900. In other words, the cylinder air flow has a generally clockwise swirl of oxidant 902 around an axis more or less perpendicular to the piston motion axis in a portion of combustion chamber 904. Fuel and/or oxidant fluid ion and/or particle injection vectors 906 from a centrally positioned injector 901 may be opposed, sympathetic or transverse to oxidant swirl 902.

Referring again to FIGS. 1 and 2, suitable sensors 134, such as piezoelectric, thermoelectric, photoelectric, and/or Fabry-Perot type sensors, monitor the pressure and temperature produced by combustion chamber events and transmit such information by wireless or optical communication channels, such as fiber optic bundle 136, to computer 101. In this embodiment, some or all sensors 134 may include protective lens 138 in order to protect such sensors from the harsh environment of the combustion chamber 132 as well as control the field of view of the sensor. Lens 138 may be configured to provide a sufficiently wide-angle view of the combustion chamber and provide high-speed feedback to controller 101 to facilitate various operational adjustments in order to maximize net energy conversion efficiency and to protect the combustion chamber and power train components. Materials for protective lens 138 may include sapphire, spinel, magnesia, and quartz.

In addition to adaptive control of the fuel pressure, the valve opening duration of valve head 122 and timing of successive valve openings may be controlled. Furthermore, one, two or more power supply circuits, such as 104 and 106, may be used to provide optimized engine operation during starting (e.g., cold, warm, or hot), acceleration, deceleration, cruise, and full power operation.

Further adaptive optimization may be provided by selection of nearly speed-of-light corona discharge impetus to accelerate ignition and/or completion of combustion in a selected region of the combustion chamber in response to temperature and or pressure monitoring instrumentation such as 134 and/or 140, such as photovoltaic, piezoelectric, Fabry-Perot, strain resistance, and eddy-current position and/or motion sensors. Applications of one or more corona discharges in the pattern of activated oxidant and/or fuel ions and/or particles that enter the combustion chamber enable much greater control of oxidant and/or fuel injection, combustion, and heat generation patterns.

In addition to providing adaptive injection and ignition events, controller 101 may provide operations to overcome electrode fouling. Incipient fouling may be detected by pressure, temperature, and/or emissivity of the electrode surfaces and/or combustion chamber events by sensor 134 and/or 140. Such information is relayed to computer 101 through light pipe 142 and/or fiber optic cable such as 136 and/or by wireless information relay by one or more suitable nodes. In response, typical operating sequences are comprised of controlled events including thermal and/or electrical activation of oxidant, one or more Lorentz thrusts of oxidation ions and swept particles of air into the combustion chamber, one or more openings for one or more bursts of fuel flow past fuel control valve 120, one or more Lorentz thrusts of fuel ions and swept particles into the combustion chamber, and one or more corona discharges within the combustion chamber.

Problems often associated with using Lorentz thrusting with carbon donor fuels such as hydrocarbons, alcohols, various ethers, and carbazoles includes fouling depositions of varnish, carbon rods, soot, and/or conductive short circuits between electrodes, such as electrode surfaces 114 and 116. These problems may be overcome by loading of an oxidant, such as air that may be delivered from the combustion chamber, into the space between electrodes 114 and 116, particularly during intake and compression periods of operation. Such oxidant may be activated by heat, intermittently transferred from the electrodes, which is gained during combustion or exhaust periods. The oxidant may also be activated by application of electrical potential to produce highly activated ions and radicals, such as $O_3$, $OH^-$, and various types of $NO_x$, to react with fouling agents to produce carbon monoxide, carbon dioxide, and/or other vapors or gases that are then delivered to the combustion chamber for completion of oxidation to effectively eliminate the fouling problem.

Similarly, such oxidant activations can also accelerate ignition and completion of combustion events in the combustion chamber. Accordingly, activated oxidant particles that are produced in the annular gap between electrodes 114 and 116 may be thrust by Lorentz forces to impinge upon and oxidize any carbon donor agent to prevent harmful fouling or particle emissions and/or to produce stratified injections of such activated oxidants to subsequently accelerate fuel ignition and/or completion of combustion chamber oxidation events.

In the event that sensor 134 detects dislodged soot and other objectionable particles in the combustion chamber 132, accelerated oxidation and elimination of such particles can be stimulated in the combustion chamber by corona discharge as may be provided by operation of power supply 106 in response to controller 101. Thus, the more sophisticated capabilities of controller 101 provides extremely rapid and comprehensive optimization of the processes for adaptive injection, ignition, and combustion functions including swirl tuning of oxidant and/or fuel ions and/or particle injection patterns in the combustion chamber.

Figure 10:
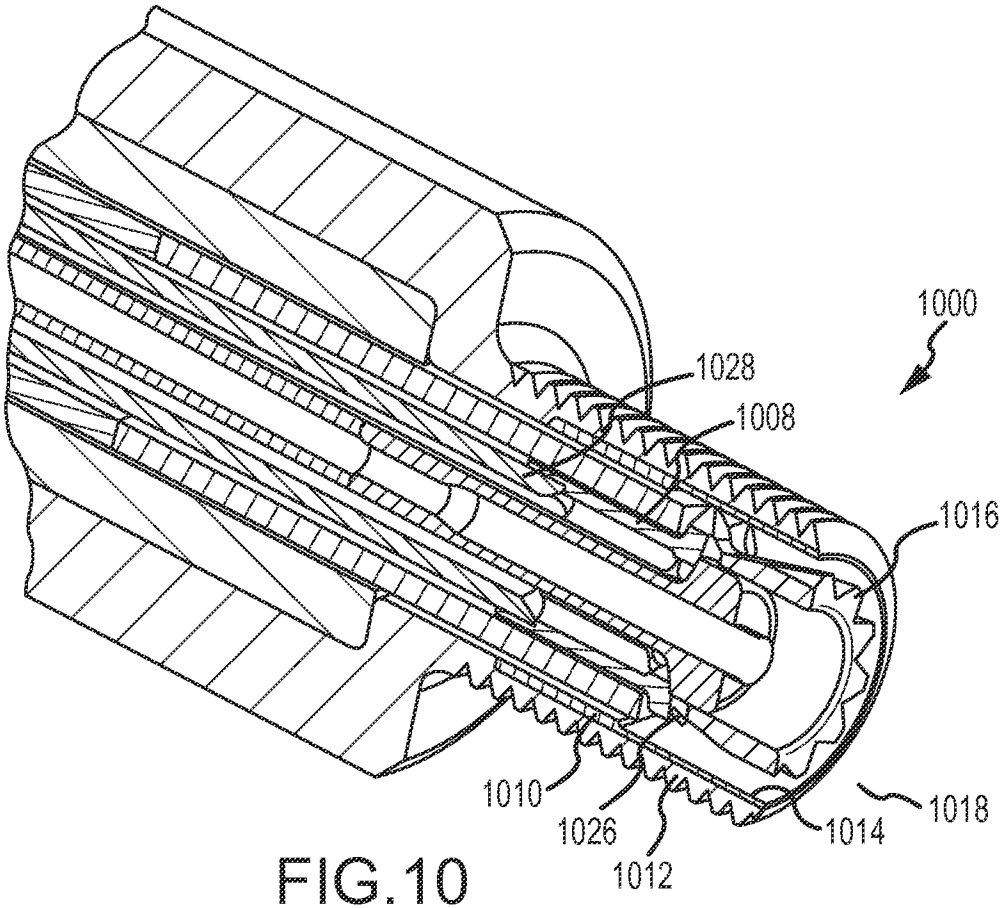
FIG. 10 is a partial cross-sectional perspective view of an injector-igniter according to a second representative embodiment.

FIG. 10 illustrates an injector-igniter 1000 incorporating adaptive swirl injection and ignition technology according to a second exemplary embodiment similar in certain ways to that described above with respect to FIGS. 1-4B; however, this embodiment, provides one or more heat transfer systems for receiving and exchanging heat generated by compression of gases such as air or other oxidants in the combustion chamber and/or from combustion gases that are delivered into the annular space between electrodes 1014, 1016. This embodiment includes two systems, 1008 and 1010, for such heat transfer and exchange operations. Heat transfer system 1010 is a tubular sleeve that serves as a thermal capacitor to receive heat from higher temperature gases that periodically flow through the annular space between electrode 1016 and the inside surface of 1010. System 1010 may include one or more layers of thermal insulation and/or serve within another suitable heat dam such as an annular gap between 1010 and surrounding structure 1012.

In some embodiments, the system further provides electrical conduction for production of ions during or in conjunction with the Lorentz thrusting processes. In other embodiments, system 1010 may include a dielectric material in certain zones to facilitate corona production and ignition operations. Suitable materials for system 1010 include various superalloys, silicon carbide, aluminum nitride and other selections that are able to provide long life with abrupt temperature cycling in oxidizing and/or reducing gases. System 1010 performs new functions that integrate zones of heat transfer in electrically conductive and electrically insulating functions along with thermal conduction and radiation enhancing heat transfers. In some embodiments, system 1010 may include conductor materials and/or structures as known to those of skill in the art, such as those features disclosed in U.S. Pat. Nos. 4,770,953; 4,659,611; 4,649,070; 4,591,537; 4,618,592; 6,017,485; and 6,096,414, all of which are incorporated herein by reference in their entireties.

Heat transfer system 1008 can be of any suitable configuration to accomplish the purposes such as depicted by the embodiment shown in FIG. 10. In this embodiment, the heat transfer system 1008 also function as a ferrule for attaching the electrode 1016 to conductor tube 1028. In some embodiments, system 1008 is produced as a graphite-based or silicon carbide composite or from fibers, filaments, or powder that is compacted and sintered of suitable super-alloy and/or a selected ceramic composition. Ion production between electrode 1016 and adjacent surface areas of system 1010 may be enhanced by enrichment with substances such as aluminum or aluminum containing compounds that reduce the energy required for such local ion production.

In operation, heat transfer systems 1008 and/or 1010 periodically receive heat from hot gases such as compression and/or combustion gases and subsequently transfer such heat to fuel particles that are periodically transferred through the annular passageway from ports such as 1026 to the combustion chamber 1018. In other words, the heat transfer systems 1008, 1010 serve as a type of thermal flywheel to regenerate the heat absorbed during compression and/or combustion. In some embodiments, this enables sufficient activation of various fuel selections to combust with little or no expenditure of electrical energy for ignition events. In other embodiments, fuel selections such as diethyl ether (DEE), dimethyl ether (DME) and other chemical plasma agents serve as combustion initiators and/or accelerants when utilized individually, in mixtures, or in blends with other fuels such as hydrogen, methane, ethane, propane, butane, ammonia and various fuel alcohols. Chemical plasma agents are detailed further in my co-pending U.S. patent application Ser. No. 13/844,240, entitled "FUEL INJECTION SYSTEMS WITH ENHANCED THRUST," and filed on Mar. 15, 2013, the disclosure of which is hereby incorporated by reference in its entirety. The amount of heat added to fuel particles passing through the space between systems 1008 and 1010 can be reduced by Lorentz thrusting of oxidant during the compression stroke to reduce or limit the heat gain that is stored and thus the amount of heat that is subsequently transferred to the fuel particles. Heat transfer can also be enhanced by the amount of swirl and turbulent flow past such heat transfer surfaces in response to the variable pressure drop and/or adaptive Lorentz thrusting.

Various control and operational permutations include combinations of variable fuel pressure, variable duration of the open time of the fuel control valve, variable duration of the time between fuel valve openings, variable current development and resulting population of oxidant ions that are thrust into the combustion chamber, variable current development and resulting population of fuel ions, the velocity and included angle of entry at which such fuel particles are thrust into the combustion chamber, variable field strength and frequency of corona ignition, and variable activation temperature of fuel constituents that are heated by inline heat exchange systems.

Figure 11:
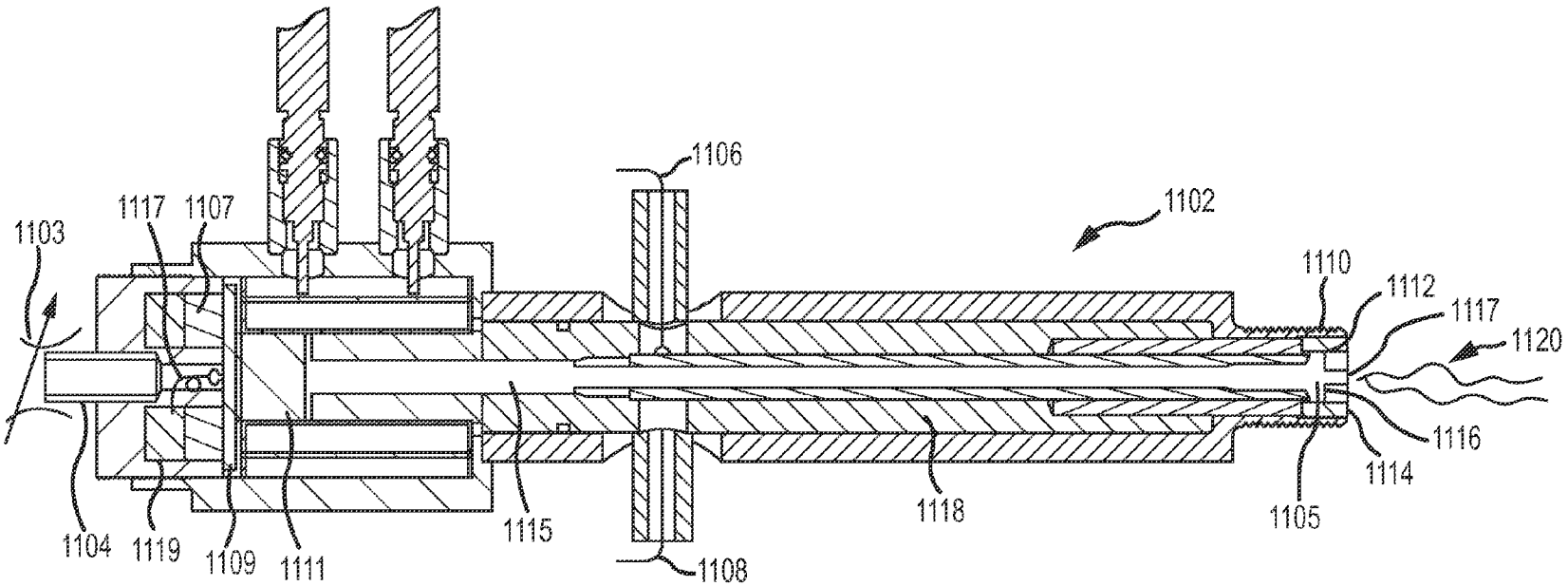
FIG. 11 is a cross-sectional side view in elevation of an injector-igniter according to a third representative embodiment.

FIG. 11 illustrates an injector-igniter 1102 incorporating adaptive swirl injection and ignition technology according to a third representative embodiment. Injector-igniter 1102 includes an outwardly opening fuel valve 1105 for utilization of less-expensive alternative fuels in diesel engines that enable production of equal power and fuel efficiency by adaptive injection patterns and ignition timing comprised of various variable combinations. Such variables include fuel pressure, Lorentz thrusting, and corona ignition.

The pressure of alternative fuel delivered through fitting 1104 is controlled by pressure regulator 1103 and the ignition characteristics are adjusted to produce adequate fuel penetration to rapidly complete fuel combustion within an insulative envelope of excess air. This provides optimized air functionality including rapid oxidation of one or more injection bursts of stratified fuel.

Lorentz thrusting of fuel and/or oxidant particles is achieved by application of sufficient electric field strength (voltage) through cable 1106 to initially develop an ion path between electrodes 1110 and 1112. This conductive ion path causes the resistance to drop and an avalanche of additional ions are produced as a current which experiences Lorentz acceleration along the annular gap between electrodes 1112 and 1110 as shown. This Lorentz thrusting process may be provided during intake, compression, or power strokes. For example the Lorentz thrusting may be provided as during intake to produce cleaning, detectable ion current patterns or other actions by activated oxidants or later during compression as the piston nears or passes top dead center (TDC) to produce activated oxidants such as $O_3$, $NO_x$, $OH^-$, and various other ions and/or radicals that are projected into the combustion chamber as a stratified charge of activated oxidants. Subsequent Lorentz acceleration of fuel particles form ions to produce current between the surface along electrodes 1110 and electrode 1112 that thrust such current one or more successive times at adaptively adjusted durations and/or intervals between injections into the combustion chamber near TDC and during the power stroke to utilize such stratified activated oxidants along with other oxidants to greatly accelerate the beginning and completion of combustion events to adaptively adjust torque to match load.

Corona ignition is produced by application of high voltage through cable 1108 to charge capacitor 1118 which rapidly discharges for a duration sufficiently small to prevent ionization of the particles between electrode zones 1114 and 1116 and thereby cause projected corona streamers 1120 to be produced within the combustion chamber and cause many more locations of combustion initiation at a multitude of distances into the combustion chamber. Ions previously provided in the combustion chamber by ion thrusting and/or chemical oxidation provide much greater corona discharge efficiency including production energy and resulting acceleration of ignition and completion of combustion process events.

Outwardly opening valve 1105 is normally closed in response to force exerted by permanent magnet 1107 on armature 1109 and thus on the tubular stem 1115 of valve 1105, which also serves as the journal bearing for axial motions of armatures 1109 and 1111. Armature 1109 closes valve 1105 and armature 1111 opens valve 1105 after gaining kinetic energy during free acceleration before impacting the end of adjustable free travel to quickly transfer kinetic energy to valve 1105 and armature 1109 and thus open valve 1105 for fuel flow into the combustion chamber. Opening of valve 1105 may be repeated numerous times near or after TDC to present multi-bursts of high surface to volume stratified charge fuel injections. Opening of valve 1105 is aided by increased fuel pressure compared to compression pressure and closing of valve 1105 is aided by the pressure produced by combustion and along with the kinetic energy development and delivery system by armatures 1109 and 1111 enables very rapid fuel injection operations, which may be further adaptively modified by one or more Lorentz accelerations to produce additional sub-bursts of injected fuel with even greater surface-to-volume ratios. In certain embodiments, combustion pressure waves coupled with resonant opening enables very rapid closing and opening motions of valve 1105. In other embodiments, further acceleration of closing and opening of valve 1105 is provided by resonant coupling of Lorentz thrusting and/or corona discharge cycling. Such operations of valve 1105 include complete and partial opening events to produce discrete bursts or flows of more and less dense particle distributions. Particle penetrations into the combustion chamber thus include variations in the included angle of entry, velocity of entry, particle density adjustments, and extents of penetration to maximize air-utilization efficiency in operational modes including idle, acceleration, cruise and full power. Adaptive application of corona ignition may further be utilized to provide extremely rapid beginning and completion of fuel combustion for an extremely wide variety of fuel selections and modes of engine operation. Selection of such adaptive operational adjustments is made in response to instrumentation such as combustion chamber monitoring communicated to controller 1119 by optical cable 1117, which is sealed within a small bore of valve 1105 and valve stem 1115.

Figure 12:
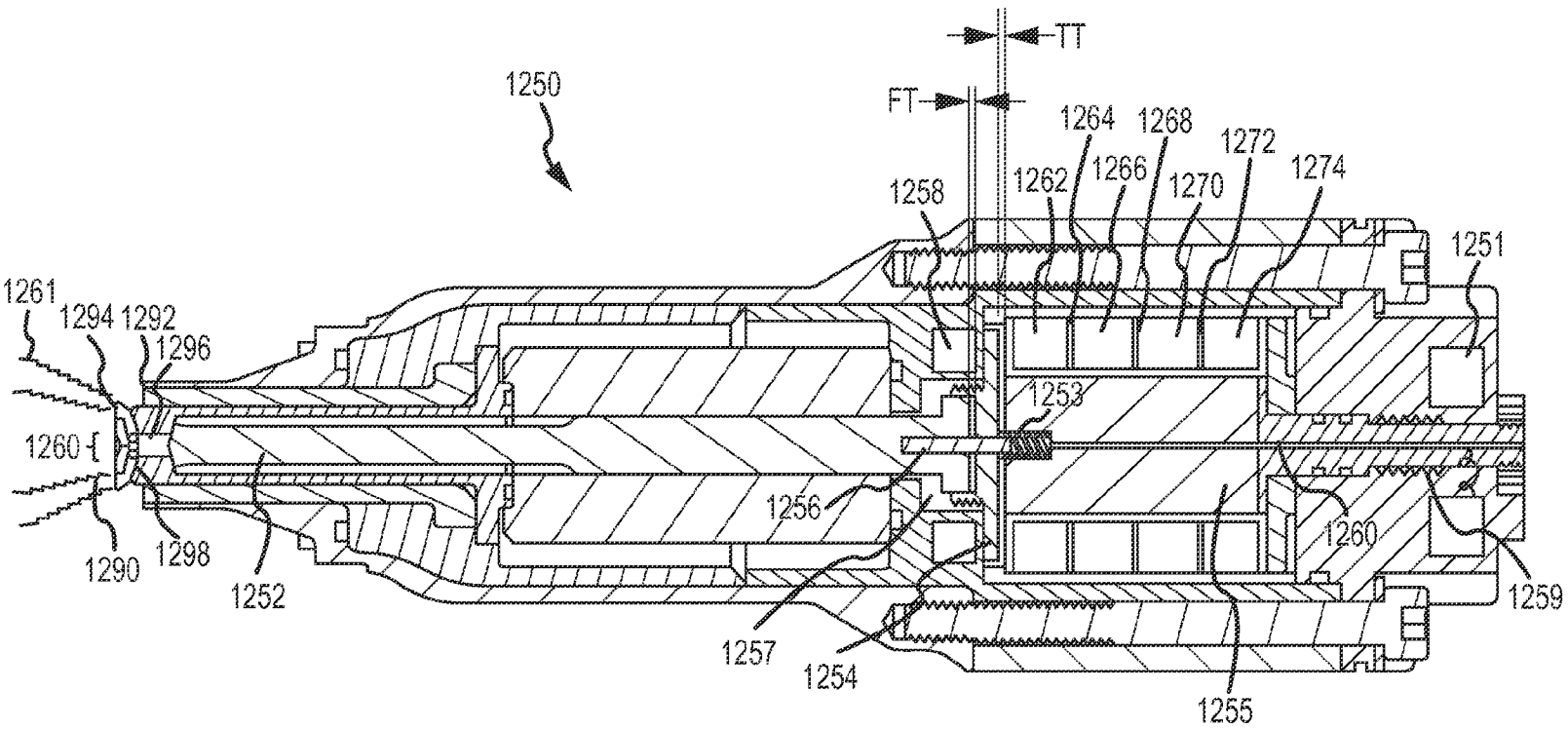
FIG. 12 is a cross-sectional side view in elevation of an injector-igniter according to a fourth representative embodiment.

FIG. 12 illustrates an injector-igniter 1250 incorporating adaptive swirl injection and ignition technology according to a fourth representative embodiment. Injector-igniter 1250 is adaptively controlled by microcomputer or processor 1251 and includes an inwardly opening fuel control valve 1252, which is quickly opened against fuel pressure by transfer of kinetic energy from armature 1254 through cap 1257 to the head of valve 1252. Valve stem 1256 serves as a linear motion bearing and kinetic energy transfer guide component for armature 1254. Upon application of current in one or more electromagnet windings 1262, 1266, 1270 and/or 1274, armature 1254 accelerates through free travel FT, and transfers kinetic energy through cap 1257 to valve 1252 as it continues to complete the adjustable linear travel TT to open valve 1252 the distance TT-FT. Adjustment of travel TT may be accomplished by axial positioning of pole-piece 1255 in response to manual or motorized inward or outward motion such as turning of thread assembly 1259 as shown. Fluid flow to control valve 1252 may be provided through any number of passageways provided through embodiment 1250 and may include fuel and/or coolant flow through suitable entry passages for one or more fluids, such as annular and/or radial passageway arrangements such as partially depicted by 1264, 1268, and/or 1272 to cool the electromagnet assembly.

In operation rapid opening of valve 1252 is provided by transfer of kinetic energy gained by adjustable free motion acceleration of armature 1254 and rapid closure of valve 1252 is provided by a suitable spring 1253 and/or magnet 1258, which is aided by force on valve 1252 produced by the fuel pressure difference compared to the combustion chamber pressure. Fuel injection into the combustion chamber is through passageways 1296, 1298 and a pattern of slots or holes to produce the desired included angle for stratified charge delivery of fuel bursts pattern 1290. In addition, passageways for pattern 1290 may be angled or otherwise volute to induce swirl in the injected fuel and/or coolant pattern. The angle of slots or holes for pattern 1290 may be tuned for a given application to provide radial, counter-rotating, or sympathetic patterns for entry into the combustion chamber. This adaptive single or multi-burst fuel injection system may be used in combination with Lorentz and/or corona ignition. In an illustrative embodiment, adaptively projected corona ignition 1261 is produced and emitted in response to the field established from electrodes 1292 and 1294 at an energy expenditure magnitude and frequency that suitably achieves the desired penetration and pattern of fuel bursts and corona ignition events for assured acceleration and completion of fuel combustion according to optimization of air functionality as monitored by instrumentation fibers 1260 for control by controller 1251, including rapid oxidation of one or more injection bursts of stratified fuel, insulation of the heat released by fuel combustion, and expansive conversion of heat released by combustion into work.

Figure 13:
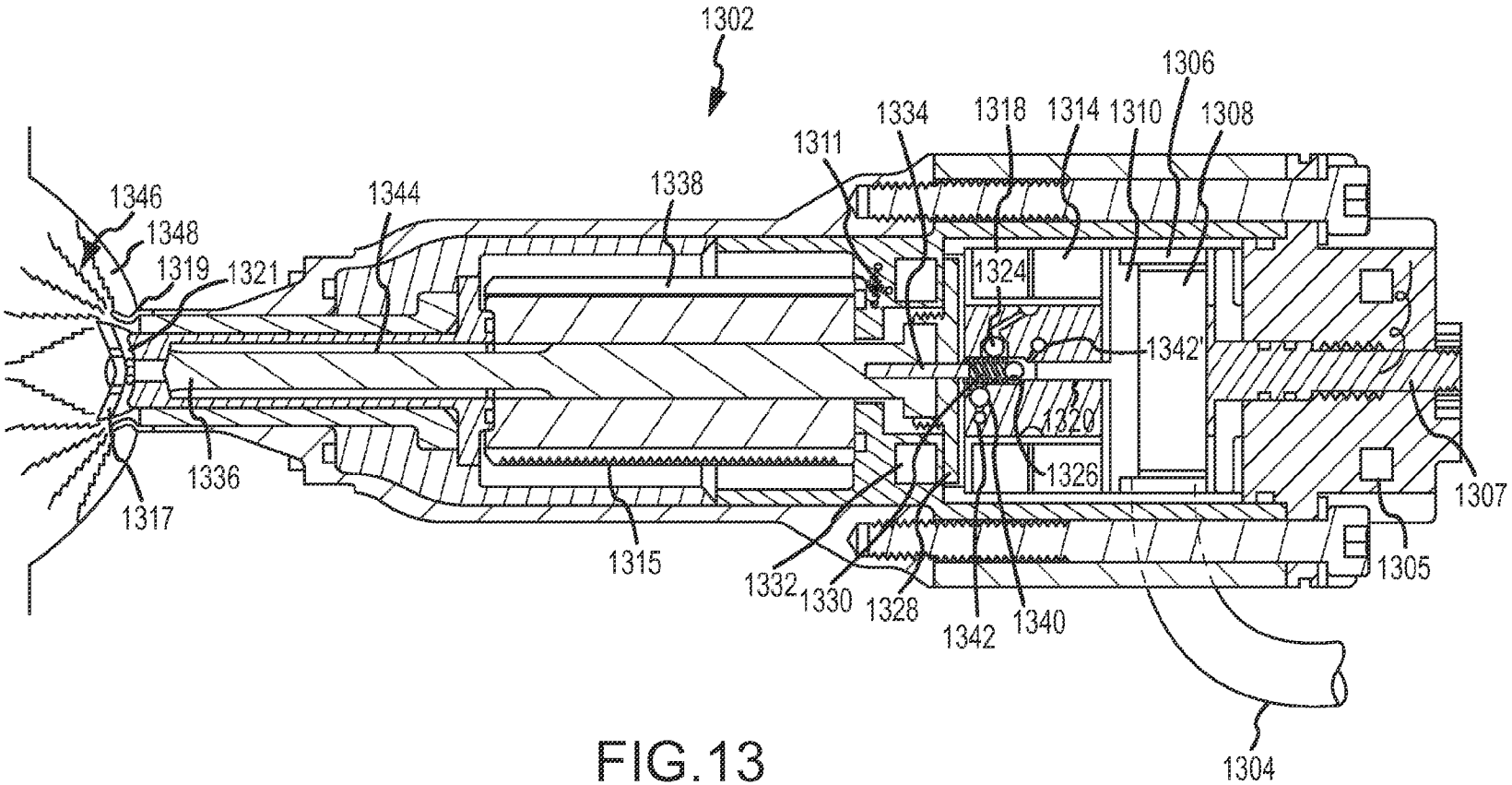
FIG. 13 is a cross-sectional side view in elevation of an injector-igniter according to a fifth representative embodiment.

FIG. 13 illustrates an injector-igniter 1302 incorporating adaptive swirl injection and ignition technology according to a fifth representative embodiment. Injector-igniter 1302 may be suitable for various purposes including combined heat and power (CHP) applications and/or for other purposes that use relatively low pressure fuels such as methane, hydrogen, carbon monoxide, methanol, or ethanol as may be provided by anaerobic digestion and/or destructive distillation and/or other dissociation or electrolysis processes. In such applications and vehicles with nearly empty tank conditions, low pressure fuel enters injector-igniter 1302 through a suitable conduit such as 1304 and is transferred internally through various sub-circuits to provide cooling of magnet wire windings 1318 and 1314 along with winding 1306 on armature 1310. Armature 1310 is aligned and supported for low-friction axial reciprocation on piston 1320 and also acts as a fluid displacement piston. Armature 1310 is accelerated by electromagnetic armature 1310 as it is forced away from electromagnet or permanent magnet 1308 as shown.

Fuel control valve 1336 is opened in response to the force generated by a suitable actuator such as a pneumatic, hydraulic, piezoelectric, magnetostrictive, or electromagnet system. As an example of an electromagnetic actuator system, armature 1328 is accelerated on bearing pin 1334 of valve 1336 and develops kinetic energy that is transferred upon reaching a motion stop or step on pin 1334 to quickly open valve 1336. Armature 1328 is returned by magnet 1332 and/or spring 1330 to restore valve 1336 to the normally closed position.

In illustrative operation, armature 1310 reciprocates axially and exerts force through attached piston 1320 to pressurize fluid delivered from conduit 1304, through the various cooling routes to one or more suitable collector circuits and past check valves such as 1324, 1342' and/or 1326. Subsequently pressurized fluid passes through check valve 1340 and conduit 1342 to storage in zones 1338 and 1344. Pressurization of storage zones such as 1338 and 1344 may be by more or less continuous operation of fluid-cooled pump assembly 1306, 1308, 1310, 1320, 1342 and 1342'. The cycle frequency and stroke of armature 1310 and thus pressurization by displacement piston 1320 may be adaptively adjusted to optimize the energy expended for pressurization and/or storage operations by axial motion of the assembly including suitable axial displacement such as by screw drive 1307 and permanent magnet 1308 in response to controller 1305. Such acceleration of armature 1310 may be in both forward and return motions according to the principles known to those of skill in the art and disclosed in U.S. Pat. Nos. 7,129,824; 5,327,120; and U.S. Patent Publication No. 2012/0095435, all of which are incorporated herein by reference in their entireties. This provides adaptive adjustments for very rapid pressurization to meet full power requirements along with lower frequency energy saving modes of operation to meet idle and low power needs.

After cooling electrical and electronic components including computer 1305 windings 1306, 1314, 1318 etc., fuels such as methane, carbon monoxide, ethane, propane, butane and ammonia etc., are heated by the compression process and fuel stored in spaces such as 1344 and 1338 can be cooled for denser storage by heat exchange to a suitable heat removal fluid such as water or water and antifreeze that is circulated through one or more heat exchangers such as depicted by 1311. In instances that it is desired to use such compressive fuel heating for purposes of ignition and combustion activation such cooling is adaptively reduced or eliminated. Further heating and thermal activation of fuels may be provided by resistive or inductive heating through elements such as 1315, depicted in storage zone 1338, in zone 1344, and other fuel transfer pathways. Such heating for beneficial fuel activation may include energy conversion of off-peak application of surplus heat and/or electricity from CHP operations, along with energy from engine deceleration, regenerative vehicle braking, regenerative utilization of fly-back energy from windings such as 1306 and/or 1314 and/or 1318, heat transfers by conduction from combustion chamber gases or by thermoelectric generation.

Electrodes 1317 and/or 1319 may have similar clockwise or counterclockwise fin and channel structures in opposing surfaces that are similar to electrode features shown in FIGS. 3A-4B and may be constructed of magnetic materials, have permanent magnets incorporated as composited components and/or include incorporated or superimposed electromagnets. Such features enable production of a wide range of fuel entry patterns in combustion chamber 1348. The pole orientations and field patterns of such magnets can provide forces to initially accelerate ions toward the center of the combustion chamber 1348 and larger included angles can be adaptively produced by adjustments in fuel injection by pressure drop and/or electromagnetic shaping and/or electrode feature shaping, and/or Lorentz thrusting away from or within the pattern shown as 1346.

Computer 1305 controls the temperature that is maintained for such beneficial activation and limits the upper temperature to prevent deposition of fuel residue and/or other precipitates due to thermal degradation. Such control of fuel temperature extends to the fluid dynamics developed in the flow through swirl passages such as 1321 through electrode 1317 and by shaping interactions with fins and/or channels to produce the desired expansion of launch vectors into combustion chamber 1348. This provides a wide variation of the included angle of fuel ion and swept fuel vectors from magnetic focus 1346 to increased swirl separation to produce array 1346 as a result of increased pressure drop and/or increased current magnitude between electrodes 1317 and 1319 to greater included angle arrays as may be varied within angle 1346 as shown commensurate with the greatest pressure drop and/or increased current between electrodes 1317 and 1319.

Figure 14:
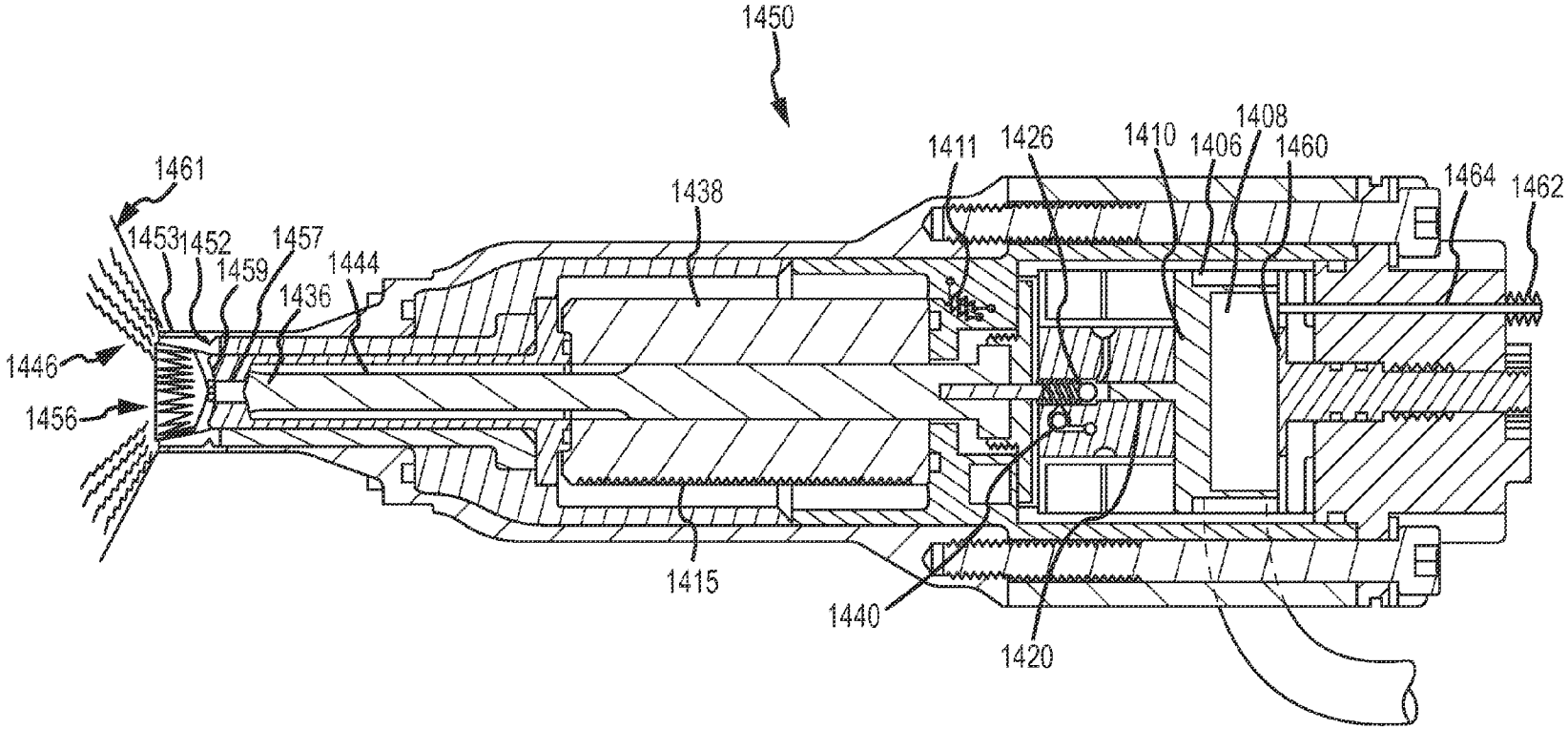
FIG. 14 is a cross-sectional side view in elevation of an injector-igniter according to a sixth representative embodiment.

FIG. 14 illustrates an injector-igniter 1450 incorporating adaptive swirl injection and ignition technology according to a sixth representative embodiment. Injector-igniter 1450 may be particularly well suited to enable various modes of operation including CHP applications that provide for anaerobic digestion, thermal dissociation and/or destructive distillation of energy crops and/or organic wastes to produce low pressure fuel constituents that are pressurized by a hydraulic pressurized compressor-pump using hermetically sealed bellows or diaphragm 1460 that is axially extended by cyclic pressure. Such pressure may be supplied by a suitable source such as the engine's oil and/or fuel pump to supplement or provide the axial force to piston 1420 or to do so in conjunction with the electromagnetic force generating system including electromagnet or permanent magnet 1408, electromagnetic magnetic winding 1406 on armature 1410. Reciprocation of piston 1420 may be forced by cyclic hydraulic pressurization and depressurization of hermetically sealed diaphragm 1460 and may be applied by suitable valve action or by the primary pump cycle as may be provided through one or more conduits such as 1464 from suitable fittings such as 1462. Such hydraulic alternative fuel pressurization combined with electrically driven solenoid pressurization enables the electrical system to provide pressurized fuel for rapid startups with low pressure fuel sources. Subsequently, hydraulic pressurization can provide rapid development of optimum pressure along with load matching to efficiently meet power and performance requirements.

In many instances diesel engines have cam-driven piston pumps to pressurize lubricating oil and similar, but much higher pressure, fuel pumps for direct injection. One or both of these pumps can be utilized such as by application of the low pressure from the lubricating oil pump for the first stage of alternative fuel compression and if desired subsequent further compression to achieve much higher pressure storage in zones 1438 and 1444 by cyclic pressure supplied by the fuel pump. In such staged pumping, diaphragms such as 1460 along with their associated pistons 1420 and valves 1426 and 1440 and others as may be suitable for various internal passageway circuits along with heat exchanger 1411 to cool the compressed gases can be located within injector 1450 or in another suitable housing (not shown) to facilitate repair, maintenance, and heat removal. Typical in-line or rotary diesel injector pumps operate at cam speed and produce 20,000 to 30,000 PSIG pressure and provide excellent matching of the alternative fuel flow with power demands.

After using lubricating oil pressure to power gaseous fuel pumping, the oil exiting the compressor drive pump can be directed to lubricate relative motion components of the engine including the valve train, piston, cam, and crank shaft, etc. Re-purposing the high pressure fuel pump by converting it from diesel fuel pressurization service to gaseous fuel pressurization with the present ignition systems allows the diesel fuel pump to operate with much less wear and fatigue stress at lower power requirements for adequate pressurization of gaseous fuels. Illustratively, operation at 20,000 to 30,000 PSI for diesel fuel pressurization can be relaxed to 800 to 2,800 PSI for adequate pressurization of gaseous fuels in conjunction with the present combustant activation and ignition systems.

Pressurized fuel stored in zones such as 1438 and 1444 can be adaptively heated by suitable heaters such as 1415 to increase the pressure and/or activation status for expedited ignition and combustion. Further heating from combustion chamber gases through heat exchange facilitated by high surface to volume electrode features 1456, 1453, and 1452 enable additional collection and transfer of activation energy. Thermal and/or high pressure whistle or ultrasonic injection activates many fuel selections such as DEE, DME, carbazoles, and/or various additives sufficiently to combust upon injection and penetration of compressed oxidant. Additional Lorentz acceleration of ion currents initiated by electrode points 1452 and that are thrust toward the combustion chamber as current rapidly builds between electrodes 1453 and 1456 provides another activation and ignition choice in the adaptive engine operation.

Projected corona ionization and ignition is provided when the sufficiently rapid rate of electric field establishment to or from electrodes 1456 to exceed the rate for forming spark type discharge. Such more efficient corona discharge is shaped to occur in the pattern of the swirl induced ion and/or fuel particle vector projections within included angle 1461 within the combustion chamber. This provides efficient utilization of electrical energy to accomplish accelerated stratified charge combustion.

Adaptively selected ignition systems include oxidant activation by Lorentz and/or corona systems to provide stratified inventories of ozone, $NO_x$ and/or other ions for igniting and fully oxidizing fuel as it injected, similar oxidant activation and injection of fuel particle ions that are produced by thermal, corona and/or Lorentz systems, and direct injection of fuel particle ions and/or other activation states that are produced by thermal, acoustic, corona and/or Lorentz systems.

Adaptive generation of highly activated oxidants such as ozone ($O_3$) and/or $NO_x$ in the combustion chamber by spark ionization or corona discharge from electrodes 1456 and/or 1453 greatly accelerates the beginning and completion of combustion. In response to crank or cam shaft acceleration detection and/or combustion chamber event monitoring, adaptive production of activated oxidants such as ozone and/or $NO_x$ may be timed to begin at an optimized crank angle and may continue for an adaptively determined period and frequency to meet torque and performance needs in accordance with fuel ignition and combustion activation by heating, corona, or other ignition systems.

Upon one or more openings of valve 1436 one or more bursts 1446 of pressurized fuel enter fuel distribution channels 1459 through passageway 1457 and are injected within the combustion chamber oxidant to undergo accelerated ignition of such fuel by activated oxidant and/or whistle or ultrasonic activation and/or by Lorentz and/or corona discharge emitted throughout the stratified fuel-oxidant mixtures that result.

Also contemplated herein are methods which may include any procedural step inherent in the structures and systems described herein. In a representative embodiment, the method comprises introducing the fuel into an annular region between two electrodes; providing a current across the two electrodes and through the fuel to establish a plasma; maintaining the current across the two electrodes to establish Lorentz forces driving the plasma from the annular region and into the combustion chamber; and imparting rotation on the fuel and plasma as it is driven from the annular region. In an embodiment, the method further comprises applying a rapid application of voltage to the two electrodes whereby ionization between the two electrodes is avoided, thereby causing a corona discharge to extend into the combustion chamber. In other embodiments, the combustion chamber contains a rotating oxidant and the rotation of the fuel and plasma is counter to the rotating oxidant. In still other embodiments, the rotation of the fuel and plasma is the same direction as the rotating oxidant. In some embodiments, the rotation of the fuel and plasma is imparted via a plurality of flow shaping features disposed on at least one of the two electrodes. In other embodiments the rotation is induced by a magnetic field.

From the foregoing it will be appreciated that, although specific embodiments of the technology have been described herein for purposes of illustration, various modifications may be made without deviating from the spirit and scope of the technology. Further, certain aspects of the new technology described in the context of particular embodiments may be combined or eliminated in other embodiments. Moreover, while advantages associated with certain embodiments of the technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein. Thus, the disclosure is not limited except as by the appended claims. The following examples provide additional embodiments of the present technology.

Examples

1. A fuel injector-igniter, comprising:

a housing;

an actuator; and a valve including a valve head operative to open and close against a valve seat in response to activation of the actuator;

wherein the valve seat includes an electrode portion extending beyond the valve head and within the housing to form at least one gap; and wherein a current discharge between the housing and electrode portion establishes a plasma and electro-magnetic forces driving the plasma from the at least one gap.

2. The fuel injector-igniter according to example 1, wherein the electrode portion includes a plurality of flow shaping features.

3. The fuel injector-igniter according to example 2, wherein the plurality of flow shaping features includes a plurality of fins disposed around the electrode portion.

4. The fuel injector-igniter according to example 3, wherein the fins are twisted, thereby operative to impart a rotation to the plasma.

5. The fuel injector-igniter according to example 1, wherein the electrode portion includes a plurality of ports in fluid communication with the annular gap.

6. The fuel injector-igniter according to example 1, further comprising a power supply connected to the housing and valve seat and operative to provide the current discharge.

7. The fuel injector-igniter according to example 1, wherein the at least one gap is an annular gap.

8. The fuel injector-igniter according to example 1, wherein the electrode portion comprises a magnetic material.

9. A fuel injector-igniter, comprising:

a housing;

a power supply;

an actuator;

a valve seat electrode including a valve seat and an electrode portion extending beyond the valve seat and within the housing to form an annular gap; and a valve including a valve head operative to open and close against the valve seat in response to activation of the actuator;

wherein the power supply is operative to produce a current discharge between the housing and electrode portion establishing a plasma and electromagnetic forces driving the plasma from the annular gap.

10. The fuel injector-igniter according to example 9, wherein the electrode portion includes a plurality of flow shaping features.

11. The fuel injector-igniter according to example 10, wherein the plurality of flow shaping features includes a plurality of fins disposed around the electrode portion.

12. The fuel injector-igniter according to example 11, wherein the fins are twisted, thereby operative to impart a rotation to the plasma.

13. The fuel injector-igniter according to example 9, wherein the electrode portion includes a plurality of ports in fluid communication with the annular gap.

14. The fuel injector-igniter according to example 9, wherein the electrode portion comprises a magnetic material.

15. A method of injecting and igniting fuel in a combustion chamber, the method comprising:

introducing the fuel into an annular region between two electrodes;

providing a current across the two electrodes and through the fuel to establish a plasma;

maintaining the current across the two electrodes to establish Lorentz forces driving the plasma from the annular region and into the combustion chamber; and imparting rotation on the fuel and plasma as it is driven from the annular region.

16. The method of example 15, further comprising applying a rapid application of voltage to the two electrodes whereby ionization between the two electrodes is avoided, thereby causing a corona discharge to extend into the combustion chamber.

17. The method of example 15, wherein the combustion chamber contains a rotating oxidant and wherein the rotation of the fuel and plasma is counter to the rotating oxidant.

18. The method of example 15, wherein the combustion chamber contains a rotating oxidant and wherein the rotation of the fuel and plasma is the same direction as the rotating oxidant.

19. The method of example 15, wherein the rotation on the fuel and plasma is imparted via a plurality of flow shaping features disposed on at least one of the two electrodes.

20. The method of example 15, wherein the rotation on the fuel and plasma is induced by a magnetic field.

The invention claimed is:

1. A fuel injector-igniter, comprising:

a housing;

an actuator; and a valve including a valve head operative to open and close against a valve seat in response to activation of the actuator;

wherein the valve seat includes an electrode portion extending beyond the valve head and within the housing to form an annular gap, wherein the electrode portion includes a plurality of ports in fluid communication with the annular gap; and wherein a current discharge between the housing and electrode portion establishes a plasma and electro-magnetic forces driving the plasma from the annular gap.

2. The fuel injector-igniter according to claim 1, wherein the electrode portion includes a plurality of flow shaping features.

3. The fuel injector-igniter according to claim 2, wherein the plurality of flow shaping features includes a plurality of fins disposed around the electrode portion.

4. The fuel injector-igniter according to claim 3, wherein the fins are twisted, thereby operative to impart a rotation to the plasma.

5. The fuel injector-igniter according to claim 1, further comprising a power supply connected to the housing and valve seat and operative to provide the current discharge.

6. The fuel injector-igniter according to claim 1, wherein the electrode portion comprises a magnetic material.

7. A fuel injector-igniter, comprising:

a housing;

a power supply;

an actuator;

a valve seat electrode including a valve seat and an electrode portion extending beyond the valve seat and within the housing to form an annular gap, wherein the electrode portion includes a plurality of fins disposed around the electrode portion and extending into the annular gap; and a valve including a valve head operative to open and close against the valve seat in response to activation of the actuator;

wherein the power supply is operative to produce a current discharge between the housing and electrode portion establishing a plasma and electromagnetic forces driving the plasma from the annular gap.

8. The fuel injector-igniter according to claim 7, wherein the fins are twisted, thereby operative to impart a rotation to the plasma.

9. The fuel injector-igniter according to claim 7, wherein the electrode portion includes a plurality of ports in fluid communication with the annular gap.

10. The fuel injector-igniter according to claim 7, wherein the electrode portion comprises a magnetic material.

11. A method of injecting and igniting fuel in a combustion chamber, the method comprising:

introducing the fuel into an annular region between two electrodes;

providing a current across the two electrodes and through the fuel to establish a plasma;

maintaining the current across the two electrodes to establish Lorentz forces driving the plasma from the annular region and into the combustion chamber; and imparting rotation on the fuel and plasma as it is driven from the annular region.

12. The method of claim 11, further comprising applying a rapid application of voltage to the two electrodes whereby ionization between the two electrodes is avoided, thereby causing a corona discharge to extend into the combustion chamber.

13. The method of claim 11, wherein the combustion chamber contains a rotating oxidant and wherein the rotation of the fuel and plasma is counter to the rotating oxidant.

14. The method of claim 11, wherein the combustion chamber contains a rotating oxidant and wherein the rotation of the fuel and plasma is the same direction as the rotating oxidant.

15. The method of claim 11, wherein the rotation on the fuel and plasma is imparted via a plurality of flow shaping features disposed on at least one of the two electrodes.

16. The method of claim 11, wherein the rotation on the fuel and plasma is induced by a magnetic field.

* * * * *